United States Patent [19]

van Mondfrans et al.

[11] Patent Number: 4,905,591

[45] Date of Patent: Mar. 6, 1990

[54] MULTICOLOR ROTARY SCREEN PRINTING MACHINE WITH AN IMPROVED SQUEEGEE SUSPENSION CONSTRUCTION

[75] Inventors: Gerardus H. van Mondfrans, Sambeek; Jacobus F. M. Peters, Ottersum, both of Netherlands

[73] Assignee: Stork Brabant B.V., An Boxmeer, Netherlands

[21] Appl. No.: 254,276

[22] Filed: Oct. 6, 1988

[30] Foreign Application Priority Data

Oct. 9, 1987 [NL] Netherlands ..... 8702412

[51] Int. Cl.[4] ..... B41F 15/10; B41F 15/42

[52] U.S. Cl. ..... 101/115; 101/120

[58] Field of Search ..... 101/129, 120, 119, 116, 101/117, 118

[56] References Cited

U.S. PATENT DOCUMENTS

| | | | |
|---|---|---|---|
| 3,313,232 | 4/1967 | Van der Winden | 101/118 |
| 3,718,086 | 2/1973 | Vertegaal | 101/120 X |
| 3,886,861 | 6/1975 | Anselrode | 101/120 X |
| 3,901,146 | 8/1975 | Stierlein | 101/120 X |
| 3,960,076 | 6/1976 | Wick | 101/120 X |
| 4,023,487 | 5/1977 | Mitter | 101/120 |
| 4,036,129 | 7/1977 | Zimmer | 101/120 |
| 4,069,756 | 1/1978 | Vertegaal | 101/120 |
| 4,070,964 | 1/1978 | Vertegaal | 101/120 |

FOREIGN PATENT DOCUMENTS

| | | | |
|---|---|---|---|
| 297812 | 11/1965 | Netherlands | 101/116 |
| 297816 | 11/1965 | Netherlands | 101/116 |
| 797912 | 1/1981 | U.S.S.R. | 101/120 |

*Primary Examiner*—Clifford D. Crowder

*Attorney, Agent, or Firm*—Kenyon & Kenyon

[57] ABSTRACT

A multicolor rotary screen printing machine comprising a number of parallel cylinder stencils which are located in a common plane and which are each provided, on the inside, with a squeegee consisting of a hollow tube with a squeegee blade, has a novel squeegee suspension. The ends of each squeegee, which project outside the stencil, are suspended from one end of each of a pair of arms, the arms each being guidably bearing-mounted along an individual screw spindle located parallel to the common plane and the screw spindles each being provided with individual driving means, such as individually controlled electric motors and gears. It is thus possible to alter the position of the squeegee within the stencil and to automate the adjustment of the squeegee during operation with the use of suitable control means acting on said individual drive means. There is a squeegee holder which consists of two hingingly interconnected sections, the angle of which with respect to one another can be varied by means of a worm and wheel segment device, through which the angle of the squeegee within the stencil can be changed.

16 Claims, 4 Drawing Sheets

MULTICOLOR ROTARY SCREEN PRINTING MACHINE WITH AN IMPROVED SQUEEGEE SUSPENSION CONSTRUCTION

BACKGROUND OF THE INVENTION

The invention relates to a multicolor rotary screen printing machine comprising a number of parallel cylinder stencils which are located in a common plane and which are each provided, on the inside, with a squeegee consisting of a hollow tube with a squeegee blade, wherein the ends of each squeegee projecting outside the stencil are suspended from one end of two arms which have their other end attached, in a hinging manner, to a supporting part connected to the frame of the machine.

Such a device is known from the Applicant's Netherlands Patent Application 6 910 509, laid open for inspection. The supporting part is a gallows attached to a bridge located transversely above the web to be printed. An arm in the form of a pneumatic or hydraulic unit extends vertically downwards from the horizontal member of the gallows. Another arm extends downwards from the vertical member approximately in the direction of the end of the first arm. Where these arms meet each other they are attached to a squeegee holder which is firmly attached to the end of a squeegee.

It is desired to be able to change the position of the squeegee inside the stencil. The correct position of the squeegee depends on various factors, such as the type of squeegee (squeegee with fixed squeegee blade, squeegee with squeegee blade applied by means of a pneumatic bellows, squeegee for foamed printing paste), possibly the depth of the squeegee blade, the pressure with which the squeegee (or its squeegee blade) is applied against the stencil, the angle of the squeegee blade with respect to the stencil. It is also desirable in operation to be able to alter the position of the squeegee in the stencil.

It is possible to alter only the length of the first arm during operation of the existing device, since this consists of a piston/cylinder unit; the other arm may be adjusted only by means of a screw thread. This means that only manual adjustment is possible and the adjustment cannot be automated.

The invention aims, on the one hand, to provide a squeegee suspension of a type such that the position of the squeegee and of the variables dependent thereon may be varied over a wide area and, on the other hand, to provide a squeegee suspension which makes it possible to automate the adjustment of the position of the squeegee.

SUMMARY OF THE INVENTION

These objects are achieved by means of a screen printing machine of the abovementioned type, each of the abovementioned other ends of the arms being guidably bearing-mounted along a screw spindle located parallel to the common plane and each screw spindle being provided with individual driving means.

The first proposed object is achieved by means of a screen printing machine of this type in that each of the arms may be moved via its individual screw spindle which is driven independently of the others. The second proposed object is achieved in that the drive means may be connected to a device which controls the adjustment of the position of the squeegee.

Advantageous embodiments are contemplated. For instance, in accordance with one preferred embodiment of the present invention, the squeegee may be suspended from one end of two arms which have their other end hingedly attached to a supporting part connected to the frame. The arms can be constructed of parallel strips which are connected together by means of bridges. This squeegee holder which makes a simple and rapid connection of the squeegee to the squeegee suspension possible, and moreover, makes it possible to change, in a simple manner, the angle of the squeegee with respect to the stencil. The squeegee may be provided with carriers of data which may be important for adjusting the position of the squeegee so that, depending upon these data, the position of the squeegee may be varied automatically. For example, magnets may be arranged on the end of the suspension journal of the squeegee so that magnetic quantities may be detected by detectors of magnetic signals.

The invention will now be described with reference to the drawings of an exemplary embodiment.

DETAILED DESCRIPTION OF THE PREFERRED EMBODIMENT

Figure 1:
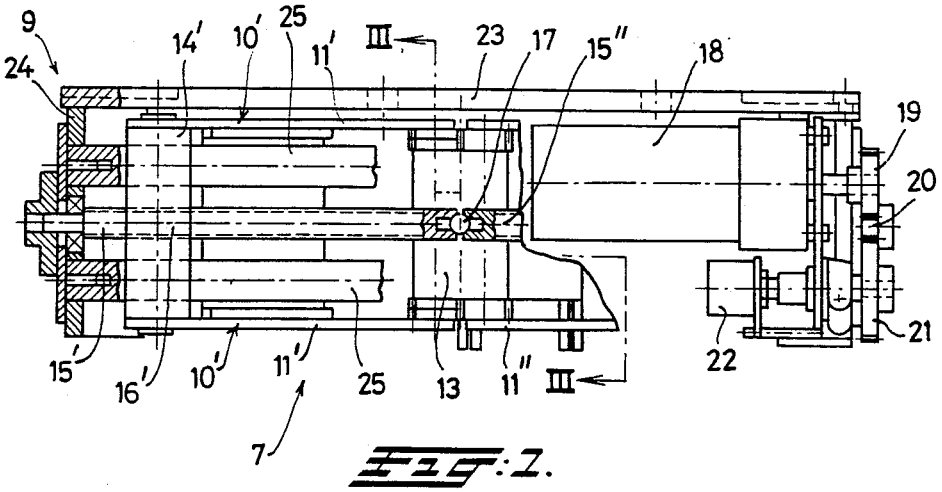
FIG. 1 shows a plan view of a squeegee suspension according to the invention, a part of which is cut away.
Figure 2:
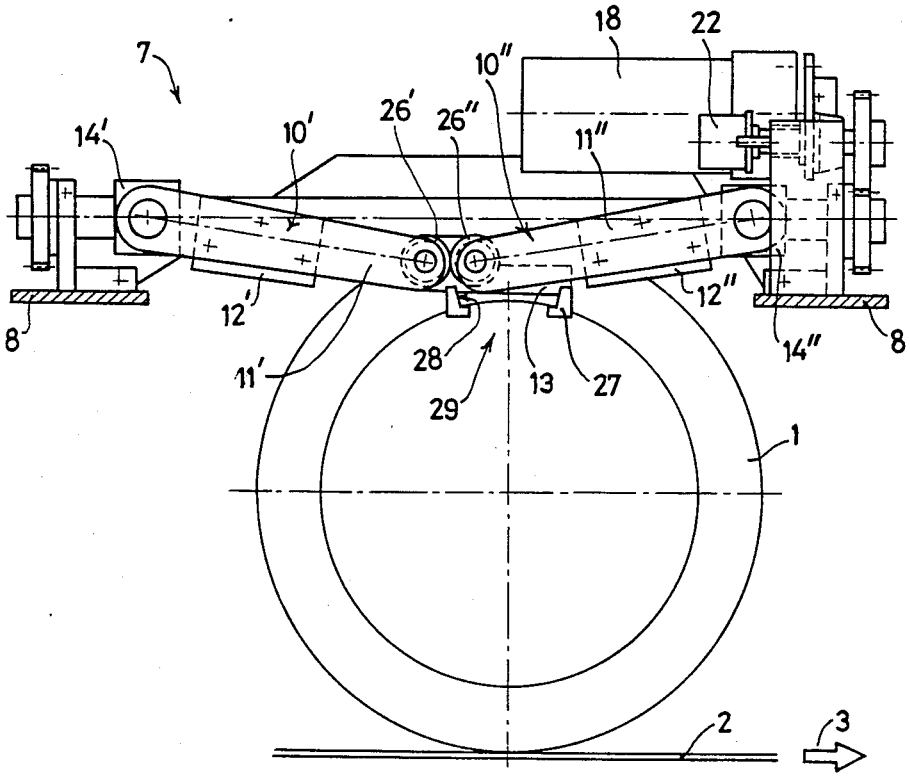
FIG. 2 shows a side view of a squeegee suspension according to the invention with a diagrammatically represented stencil.
Figure 3:
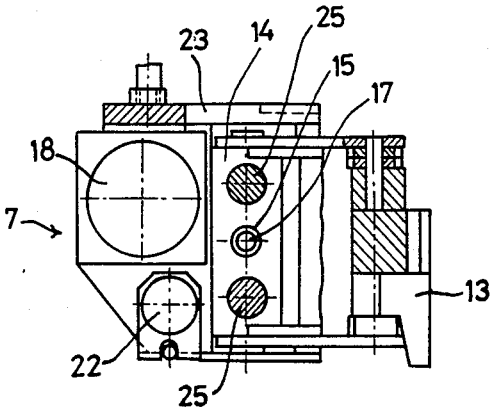
FIG. 3 shows a section along the line III—III in FIG. 1.
Figure 4:
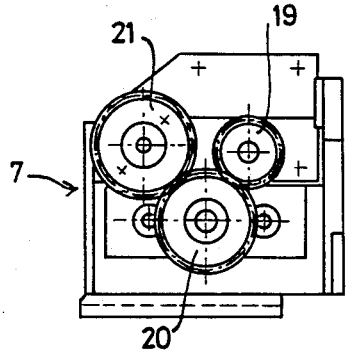
FIG. 4 shows an end view of the squeegee suspension according to the invention.

FIGS. 1 and 2 show a squeegee suspension which is intended to be used as a subcomponent of a multicolor rotary screen printing machine from an installation which is described in more detail in the co-pending Netherlands patent application 87.02408. The screen printing machine is provided with a number of thin-walled cylindrical screen printing stencils 1, one of which is shown diagrammatically in FIG. 2. The stencils 1 lie in a common horizontal plane. A web 2 of material to be printed is conveyed under these stencils in the direction of the arrow 3. The stencil 1 is driven in rotation in a direction and at a speed such that at the position where it touches the web of material 2 to be printed there is no difference or a very small difference in speed between these two.

The device for driving the stencil in rotation is located on one side of the screen printing machine (the drive side); for a description thereof, attention is drawn to the related patent application already mentioned.

Figure 5:
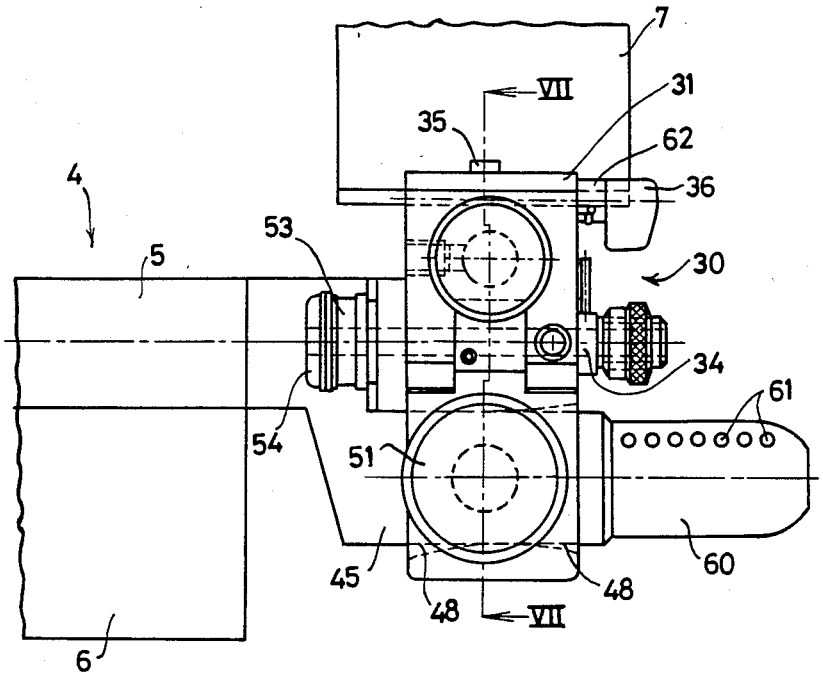
FIG. 5 shows a horizontal view of a squeegee holder according to the invention intended for firmly holding one end of a squeegee (the drive side)

A squeegee 4, partially illustrated in FIG. 5, is suspended in the stencil 1. The squeegee has the construction of a hollow tube 5 to which a spreading blade 6 (hereinafter squeegee blade) is attached. The squeegee blade 6 touches the inside wall of the stencil 1 in or close to its lowermost region and can be applied against the stencil 1 with more or less pressure, depending on the printing conditions.

Printing paste is pumped into the hollow tube 5 from the side of the machine located opposite the drive side (the pump side) and via openings provided therein behind the squeegee blade 6 in order to be applied onto the web 2 to be printed via the perforations of the stencil 1.

The squeegee 4 is suspended via a squeegee suspension 7, to be described below, from a supporting piece 9 connected to the machine frame 8.

The squeegee suspension principally comprises two arms 10', 10" which are constructed as two parallel strips 11', 11", in the exemplary embodiment illustrated, which are joined together by means of bridges 12', 12". At one end the arms are attached to a connecting part 13. The other ends are each connected, via a follower block 14', 14", to a screw spindle 15', 15". The ends of the blocks are attached to the ends of their respective arms 10', 10" and each have a bore 16 provided with a screw thread through which the screw spindles 15', 15" are guided.

The two screw spindles 15', 15" are rotatable with respect to each other and are joined to one another by means of a ball joint 17. The screw threads of the screw spindles may face in the same direction or be opposed to each other.

The drive of each screw spindle 15', 15" takes place by means of an electric motor 18. Only the driving members of the right screw spindle 15" are illustrated. A gear wheel 19, which engages in a reduction gear wheel 20, is securely attached to the outlet shaft of the electric motor 18.

The reduction gear wheel 20 is securely attached to the screw spindle 15". The reduction gear wheel 20 in turn engages in a gear wheel 21 which is attached to the inlet shaft of a potentiometer 22. The potentiometer 22 detects the position of the screw spindle 15", via the gear wheels 20 and 21, and conveys this to a microprocessor (not shown).

The microprocessor is connected to an electronic control unit (also not shown). The drive of the screw spindle 15' is similar to that of the screw spindle 15", with the proviso that the electronic control unit is common and controls the two electric motors 18 as a function of the chosen position of the squeegee. Continuous control by the control unit takes place via the potentiometers 22 and the microprocessors.

The supporting part 9, via which the suspension 7 is attached to the machine frame 8, consists of a longitudinal part 23 and two transverse parts 24 (FIG. 1, 3). Two guide rods 25, on which the blocks 14', 14" are slidably bearingmounted, extend between the two transverse parts so that the screw spindles 15', 15" do not have to pass the entire load of the squeegee 4 onto the suspension 7.

At the ends which are attached to the connecting part 13, the arms 10', 10" are provided with toothings 26', 26" (FIG. 2). In the exemplary embodiment illustrated here, these toothings 26', 26" consist of gear wheels securely attached to the arms near the ends.

As may be best seen in FIG. 1, the connecting part 13 extends between the ends of the strips 11 which form the arms 10', 10". A projection 27 is formed on the connecting part 13 in which a groove 28 is provided which is designed to act as one part 29 of a quick coupling in which another corresponding part 31 of the quick coupling, formed on the squeegee holder 30 to be described below, may be pushed.

Figure 6:
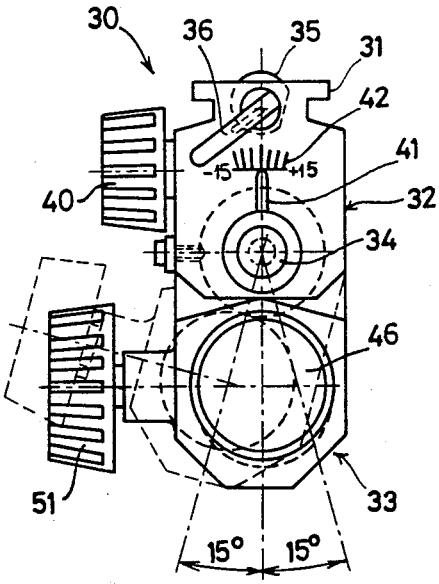
FIG. 6 shows a horizontal view of the squeegee holder of FIG. 5 turned through 90° with respect to FIG. 5.
Figure 7:
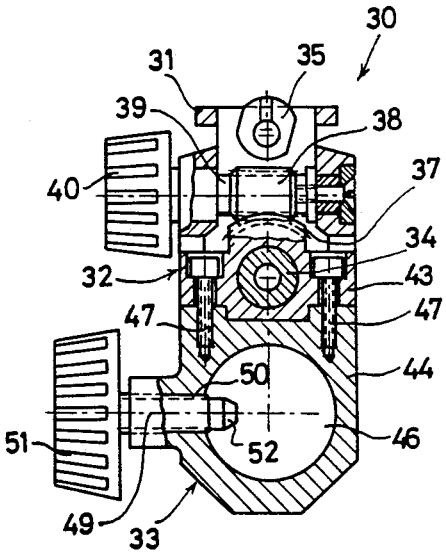
FIG. 7 shows a section along the line VII—VII of the squeegee holder of FIG. 5.

The squeegee 4 is securely held on the connecting part 13 via the squeegee holder 30. The two types of squeegee holder for the pump side and drive side, respectively, according to this embodiment of the invention, are illustrated in FIGS. 5–7 and FIGS. 8, 9, respectively. Only the squeegee holder 30 on the drive side is provided with means (to be described further) to adjust the angle of the squeegee blade 6. The seating of the squeegee 4 on the pump side of the machine follows the rotation on the drive side. This has the advantage that simple and accurate adjustment of the squeegee angle may take place from one side of the machine. This squeegee holder 30 will now be described (FIGS. 6 and 7).

The squeegee holder 30 consists of two sections 32 and 33. These are attached to each other in a hinging manner by means of a shaft 34. This shaft is securely attached to the second section 33 of the squeegee holder 30.

The first section 32 of the squeegee holder is provided with a coupling half 31 corresponding to the half 29 of a quick coupling which is arranged in the connecting part 13. As a result of this the squeegee holder may be attached to the connecting part 13. The squeegee holder may be held in the coupling half 29 by means of an eccentric cam 35 which, via a shaft 62, may be operated by means of a lever 36.

A worm wheel segment 37 is securely attached to the shaft 34. A worm 38 engages in this worm wheel segment. This worm may be rotated, via a shaft 39, by means of a knob 40. The mutual angle between the two sections of the squeegee holder may thus be varied. An indicator 41 is attached to the shaft 34, and by means of this indicator the adjusted angle may be read off on a graduation scale 42 punched in the first section of the squeegee holder.

The second section of the squeegee holder consists of two sections: the section 43, to which the shaft and the worm wheel segment are attached, and the section 44, in which the opening 46 is located in which a journal 45 of the squeegee is received. These two sections are attached to each other by means of socket head bolts 47.

The section 44 has an opening 46 in which the journal 45 of the squeegee 4 is received. As may best be seen in FIG. 5, this opening is provided with run-on sides 48. The journal of the squeegee is securely held by means of a screw 49 which is located in a bore 50 provided with an internal screw thread and is provided with a knob 51. The end of the screw 49 is provided with a tapered section 52 which fits into a conical hole (not shown) in the journal 45 of the squeegee 4 so that, by rotating the screw 49, the squeegee 4 automatically assumes its correct position with respect to the squeegee holder 30.

A projection 53 is attached to the squeegee holder 30 in the exposed part of the shaft 34 and concentric therewith. This projection 53 fits into a corresponding opening 54 in an end face of the squeegee 4. As a result of this and by receiving the journal 45 of the squeegee in the opening 46, it is assured that the squeegee follows the angular adjustment of the first (32) and second (33) sections of the squeegee holder with respect to each other.

Figure 8:
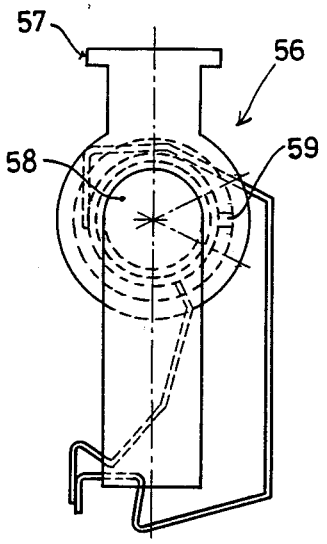
FIG. 8 shows an end view of a squeegee holder intended to firmly hold the other end of the squeegee (the pump side)
Figure 9:
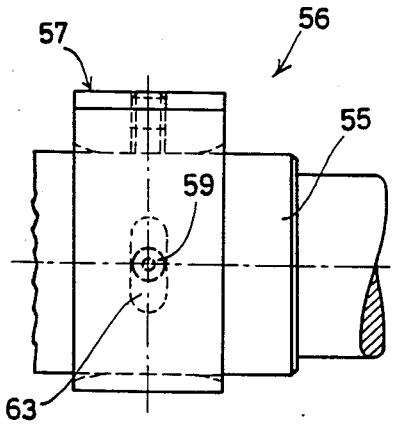
FIG. 9 shows a front view of the squeegee holder of FIG 8.

At its opposite end 55, the squeegee 4 is securely held by another squeegee holder 56 (FIGS. 8. 9). This has a coupling half 57, corresponding to the coupling half 29 arranged in the connecting part 13, which essentially corresponds to the coupling half 31 or the squeegee suspension 30 already described. In addition, this other squeegee holder 56 has an opening 58 in which the other end 55 of the squeegee 4 is received. The squeegee 4 follows the angular adjustment of the squeegee holder 30, described earlier, in this squeegee holder 56. A slot 63 is arranged in the squeegee holder 56 in which the head 59 of a screw arranged in the squeegee end 55 is located. This prevents the squeegee holder 56 shifting axially with respect to the squeegee end 55.

A row of shallow holes 61 is located at the end 60 of the journal 45 of the squeegee 4. Magnets may be located on one or more of these holes which act as carriers-of data relating to the type of squeegee, the adjustment of the position of the squeegee within the stencil 1 or the like. A detector (not shown) of magnetic signals may be located opposite these holes. This detector may be connected to a device for controlling the position of the squeegee.

What is claimed is:

1. A multicolor rotary screen printing machine comprising a plurality of parallel cylinder stencils supported on a machine frame in a common plane;

a squeegee provided inside each of the stencils, the squeegee comprising a hollow tube and a squeegee blade extending from the hollow tube, each squeegee having opposed longitudinal ends projecting outside the stencils;

a squeegee suspension for suspending each squeegee above the machine frame, the squeegee suspension comprising:

two arms, two follower blocks and two screw spindles;

the screw spindles being rotatably mounted in the machine frame, and extending substantially parallel to the common plane;

the two arms supporting at least one end of each squeegee, each one of the two arms having a first end connected to the squeegee and a second end operatively connected to an associated one of the two follower blocks;

each of the follower blocks being threaded onto an associated one of the two screw spindles so as to be linearly displaced by rotation of the respective screw spindle so that at least one end of the squeegee is suspended from the machine frame by the two arms, the follower blocks and the screw spindle; and each of the screw spindles having individual drive means so that the position of each one of the follower blocks and pivotally connected arm, can be independently adjusted to enable adjustment of the position of the squeegee.

2. The screen printing machine of claim 1, wherein the two screw spindles of each squeegee suspension are located in line with one another.

3. The screen printing machine of claim 2, wherein adjacent ends of the two screw spindles of each squeegee suspension are connected together via a movable ball joint.

4. The screen printing machine of claim 1, wherein the driving means of each screw spindle comprises an individually controlled electric motor.

5. The screen printing machine of claim 1, further comprising a quick coupling connecting each squeegee to the two arms, the quick coupling comprising a first connecting part pivotally connected to the first end of each of the arms, and a second complementary coupling part connected to the squeegee, the complementary coupling part being selectively connectable to the connecting part.

6. The screen printing machine of claim 5, further comprising a squeegee holder, the squeegee holder securely holding the squeegee and the squeegee holder being securely held on the complementary connecting part.

7. The screen printing machine of claim 6, further comprising a journal formed on the end of the squeegee and a journal receiving opening in the squeegee holder, the journal being fastenable in the journal receiving opening.

8. The screen printing machine of claim 7, wherein the journal of the squeegee comprises magnets arranged on an end thereof such that magnetic quantities may be detected by detectors of magnetic signals.

9. The screen printing machine of claim 7, wherein the squeegee holder comprises first and second sections, the first section being provided with the complementary coupling part of the quick coupling, the second section comprising the journal receiving opening, the first and second sections being connected together by means of a rotation shaft and the angle at which the first and second sections stand with respect to each other being variable.

10. The screen printing machine of claim 9, wherein the angle of the first section and the second section may be adjusted with respect to each other by means of a worm wheel segment securely attached to a shaft which is securely attached to the second section and a worm which interacts therewith and is rotatably mounted in the first section, the worm and worm wheel allowing angular adjustment of the first and second sections with respect to one another.

11. The screen printing machine of claim 10, the squeegee holder further comprising a projection provided on one of an end face of the squeegee and the face of the squeegee holder facing the squeegee, the projection being arranged coaxially with the rotation shaft, and a corresponding opening arranged in the other of the face of the squeegee holder facing the squeegee and the end face of the squeegee, the projection being receivable in the opening.

12. The screen printing machine of claim 9, the squeegee holder further comprising an eccentric cam connected to an operating lever via a shaft for holding the squeegee holder in the connecting part.

13. The screen printing machine of claim 6, wherein the squeegee holder is present only on one end of the squeegee, the other end of the squeegee being rotatably mounted.

14. The screen printing machine of claim 1, wherein the first end of each of the two arms are provided with fixed toothings, the toothings engaging in corresponding toothings on the other one of the two arms.

15. The screen printing machine of claim 1, wherein each of said arms comprises two parallel strips which are connected together by means of bridges.

16. The screen printing machine of claim 1, the squeegee suspension comprising two parallel arms having first and second ends, the squeegee being suspended on the first ends and the second ends being pivotally attached to a supporting part connected to the frame of the machine, wherein each of the second ends of the arms is mounted so as to be guidable along a screw spindle located parallel to the arms, and each screw spindle is provided with individual driving means.

* * * * *